US008764150B2

(12) United States Patent
Aoyama et al.

(10) Patent No.: US 8,764,150 B2
(45) Date of Patent: Jul. 1, 2014

(54) INK JET RECORDING METHOD AND INK JET RECORDING APPARATUS

(71) Applicant: Seiko Epson Corporation, Tokyo (JP)

(72) Inventors: Tetsuya Aoyama, Shiojiri (JP); Ippei Okuda, Shiojiri (JP); Hidehiko Komatsu, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/852,454

(22) Filed: Mar. 28, 2013

(65) Prior Publication Data

US 2013/0286069 A1 Oct. 31, 2013

(30) Foreign Application Priority Data

Apr. 27, 2012 (JP) ..... 2012-102728

(51) Int. Cl.
*B41J 2/15* (2006.01)

(52) U.S. Cl.
USPC ..... 347/14; 347/15

(58) Field of Classification Search
USPC ..... 347/12, 14, 15, 43, 95, 100, 102
See application file for complete search history.

(56) References Cited

U.S. PATENT DOCUMENTS

| | | | | |
|---|---|---|---|---|
| 7,244,021 | B2 * | 7/2007 | Arai | 347/102 |
| 7,753,516 | B2 * | 7/2010 | Yoneyama | 347/102 |
| 8,585,198 | B2 * | 11/2013 | Onishi et al. | 347/102 |
| 2005/0235870 | A1 | 10/2005 | Ishihara | |
| 2010/0086690 | A1 | 4/2010 | Aoki | |
| 2012/0156449 | A1 | 6/2012 | Tateishi et al. | |

FOREIGN PATENT DOCUMENTS

| | | | |
|---|---|---|---|
| JP | 2002225255 | A | 8/2002 |
| JP | 2009137124 | A | 6/2009 |
| WO | WO-2011027842 | A1 | 3/2011 |

* cited by examiner

*Primary Examiner* — Lamson Nguyen
(74) *Attorney, Agent, or Firm* — Harness, Dickey & Pierce, P.L.C.

(57) ABSTRACT

The ink jet recording method according to the invention includes a first image recording step of recording an image by adhering the background ink to a first region and a second region of a recording medium; a second image recording step of recording an image by adhering a color ink onto the background ink of the first region; and a heating step of heating the recording medium at 35° C. to 100° C., and in which at least one of the background ink and the color ink does not contain a pyrrolidone derivative with a standard boiling point of 240° C. or higher.

18 Claims, 6 Drawing Sheets

INK JET RECORDING METHOD AND INK JET RECORDING APPARATUS

Priority is claimed under 35 U.S.C. §119 to Japanese Application No. 2012-102728 filed on Apr. 27, 2012, is hereby incorporated by reference in its entirety.

BACKGROUND

1. Technical Field

The present invention relates to an ink jet recording method and an ink jet recording apparatus.

2. Related Art

An ink jet recording apparatus which has a nozzle that discharges ink as droplets is known in the related art. In order to obtain a desired image using such an ink jet recording apparatus, various types of inks are used. For example, JP-A-2009-137124 discloses a white ink which contains a white pigment, and a resin ink which contains a resin and does not contain a color material. It is also disclosed that a white image with excellent abrasion resistance can be obtained using these inks.

Here, in addition to a case in which glitter inks containing the white ink or a glitter pigment (for example, an aluminum pigment) are used individually to form an image, there are is also a case in which the glitter ink is used in the formation of an image for the background of a color image (that is, the undercoat layer of the color image). For example, the white ink is used in the formation of a white shielding layer for lowering the permeability of the color image when a color image is recorded onto a recording medium such as a transparent sheet. In addition, the glitter ink is used in the formation of the undercoat layer when it is desirable to impart a metallic appearance to the color image.

By forming a background image in this manner, it is possible to improve the color development of the color image recorded thereon, and to impart a particular color tone.

When forming a color image onto a background image, the fixing properties of the color image may be insufficient, and the fixing properties of the regions of the background image on which the color image is not formed may be insufficient. In order to suppress such reductions in the fixing properties of the image, it is conceivable to employ a method in which, for example, the color image and the background image are coated with a resin ink, or, in which each of the inks and the resin ink are used together.

However, there is a case in which, even when an improvement in the fixing properties of the image is obtained using a resin ink, the drying properties of the image are reduced due to a component contained in the ink for forming the background image (hereinafter, also referred to as the "background ink") or the ink for forming the color image (hereinafter, also referred to as the "color ink"), and sufficient fixing properties may not be obtained.

In addition, when the resin ink is used, the amount of water or volatile components (for example, an organic solvent) originating from the ink of the recording medium increases, therefore there is a case in which the drying properties of the image recorded on the recording medium are remarkably reduced.

SUMMARY

An advantage of some aspects of the invention is to provide an ink jet recording method and an ink jet recording apparatus which can record images having excellent drying properties and fixing properties.

The invention can be realized in the following forms or application examples.

Application Example 1

According to Application Example 1, there is provided an ink jet recording method that discharges ink from a nozzle of an ink jet recording head and records an image to a recording medium, the method including a first image recording step of recording an image by discharging a background ink containing a background color material such that it adheres to a first region and a second region of the recording medium; a second image recording step of recording an image by discharging a color ink containing a color material other than the background color material such that it adheres onto the background ink of the first region; and a heating step of heating the recording medium at 35° C. to 100° C., in which at least one of the following (A) and (B) is satisfied where (A) the second image recording step is a step that records the image by discharging a resin ink, which contains a resin and does not substantially contain the color material, and the color ink at substantially the same time such that they adhere onto the background ink of the first region, and (B) the ink jet recording method further includes a third image recording step of recording an image by discharging the resin ink such that it adheres onto the color ink of the first region, and in which at least one of the background ink and the color ink does not substantially contain a pyrrolidone derivative with a standard boiling point of 240° C. or higher.

In this case, an image having excellent drying properties and excellent fixing properties can be recorded.

Application Example 2

In the ink jet recording method according to Application Example 1, when (A) is satisfied, the second image recording step may include recording the image by adhering the resin ink onto the background ink of the second region.

Application Example 3

In the ink jet recording method according to Application Example 1 or 2, when (B) is satisfied, the third image recording step may include recording the image by adhering the resin ink onto the background ink of the second region.

Application Example 4

In the ink jet recording method according to any one of the examples Application Examples 1 to 3, both of (A) and (B) may be satisfied.

Application Example 5

In the ink jet recording method according to any one of the examples Application Examples 1 to 4, neither of the background ink and the color ink may substantially contain a pyrrolidone derivative with a standard boiling point of 240° C. or higher.

Application Example 6

In the ink jet recording method according to any one of the examples Application Examples 1 to 5, the background ink and the color ink may each contain the resin, in which the total content of the resin and the background color material in the background ink may be 9 mass % or more; and in which the total content of the resin and the color material other than the background color material in the color ink may be 9 mass % or more.

Application Example 7

In the ink jet recording method according to any one of the examples Application Examples 1 to 6, the amount of the background color material contained in the image recorded in the first image recording step may be 0.8 mg/inch$^2$ or more.

Application Example 8

In the ink jet recording method according to any one of the examples Application Examples 1 to 7, when (A) is satisfied, the color ink and the resin ink may be discharged during the same scan of the ink jet recording head in the second image recording step.

Application Example 9

According to Application Example 9, there is provided an jet recording apparatus which uses the ink jet recording method according to any one of the examples Application Examples 1 to 8.

In this case, an image having excellent drying properties and excellent fixing properties can be recorded.

Application Example 10

According to Application Example 10, there is provided an ink jet recording apparatus including an ink jet recording head provided with a nozzle which discharges ink; a control unit which executes a plurality of modes; and a heating unit, in which, the plurality of modes include a first mode which records an image by discharging a background ink containing a background color material such that it adheres to a first region and a second region of a recording medium; a second mode which selects and performs recording an image by discharging a color ink containing a color material other than the background color material such that it adheres onto the background ink of the first region; or recording an image by discharging a resin ink, which contains a resin and does not substantially contain the color material, and the color ink at substantially the same time such that they adhere onto the background ink of the first region; and a heating mode which heats the recording medium at 35° C. to 100° C. using the heating unit, in which the control unit executes the first mode, the second mode and the heating mode, and in which at least one of the background ink and the color ink does not substantially contain a pyrrolidone derivative with a standard boiling point of 240° C. or higher.

In this case, an image having excellent drying properties and excellent fixing properties can be recorded.

Application Example 11

In the ink jet recording apparatus according to Application Example 10, the plurality of modes may further include a third mode which selects and performs recording the image by discharging the resin ink such that it adheres onto the color ink of the first region, or not adhering the resin ink onto the color ink of the first region, and in which the control unit may cause the first mode, the second mode, the third mode and the heating mode to be executed.

BRIEF DESCRIPTION OF THE DRAWINGS

The invention will be described with reference to the accompanying drawings, wherein like numbers reference like elements.

DESCRIPTION OF EXEMPLARY EMBODIMENTS

The preferred embodiments of the invention are described below. The embodiments described below are for describing examples of the invention. In addition, the invention is not limited by the following embodiments and includes various modifications carried out in a range not departing from the gist of the invention. Furthermore, not all of the configurations explained in the embodiments below are necessary configuration requirements for the invention.

1. Ink Jet Recording Method

The ink jet recording method according to an embodiment of the invention is an ink jet recording method that discharges ink from a nozzle of an ink jet recording head and records an image to a recording medium, the method including a first image recording step of recording an image by discharging a background ink containing a background color material such that it adheres to a first region and a second region of the recording medium; a second image recording step of recording an image by discharging a color ink containing a color material other than the background color material such that it adheres onto the background ink of the first region; and a heating step of heating the recording medium at 35° C. to 100° C., in which at least one of the following (A) and (B) is satisfied where (A) the second image recording step is a step that records the image by discharging a resin ink, which contains a resin and does not substantially contain the color material, and the color ink at substantially the same time such that they adhere onto the background ink of the first region, and (B) the ink jet recording method further includes a third image recording step of recording an image by discharging the resin ink such that it adheres onto the color ink of the first region, and in which at least one of the background ink and the color ink does not substantially contain a pyrrolidone derivative with a standard boiling point of 240° C. or higher.

Detailed description is given below for each step in relation to the ink jet recording method according to the present embodiment.

1.1. First Image Recording Step

The first image recording step records the image by discharging the background ink (described below) such that it adheres to the first region and the second region of the recording medium.

Figure 1A:
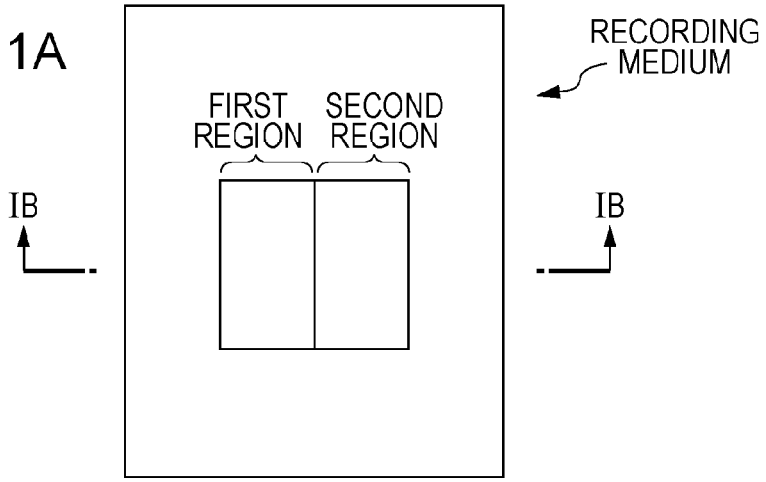
FIGS. 1A and 1B schematically show a recording medium to which a background image (W) is recorded using the first image recording step in the recording method according to the present embodiment.
Figure 1B:
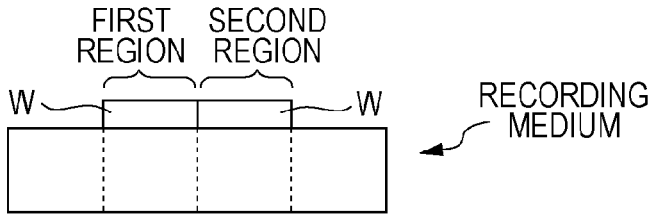

FIGS. 1A and 1B schematically show a recording medium to which the background image (W) is recorded using the first image recording step. Specifically, FIG. 1A shows the upper face of the recording medium in which the background image (W) is recorded to the first region and the second region. Further, FIG. 1B shows the cross-section along the line IB-IB of FIG. 1A.

In this manner, the background image (W) formed from the background ink is recorded onto the first region and the second region using the first image recording step.

The amount of the background color material (described below) contained in the image recorded in the first image recording step is preferably 0.8 mg/inch$^2$ or more, more preferably 0.9 mg/inch$^2$ or more, and even more preferably 1.3 mg/inch$^2$ or more. Since it is possible to reduce the influence of the color of the recording medium and to suppress the color image from permeating when using a transparent sheet by setting the amount of the background color material to 0.8 mg/inch$^2$ or more, there is a case in which the color development of the color image recorded onto the background image can be improved.

1.2. Second Image Recording Step

The second image recording step is performed after the first image recording step, and records the image by discharging at least the color ink (described below) such that it adheres onto the background ink of the first region.

Figure 2A:
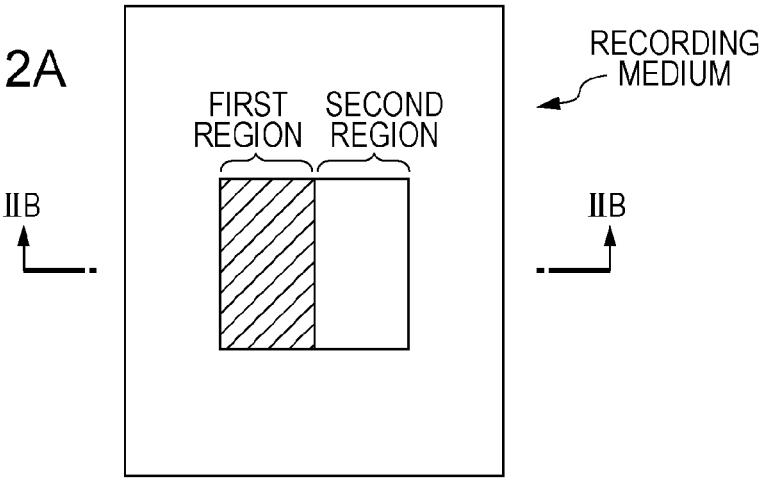
FIGS. 2A and 2B schematically show a recording medium to which a color image (Co) is recorded onto the background image (W) of a first region using the second image recording step in the recording method according to the present embodiment.
Figure 2B:
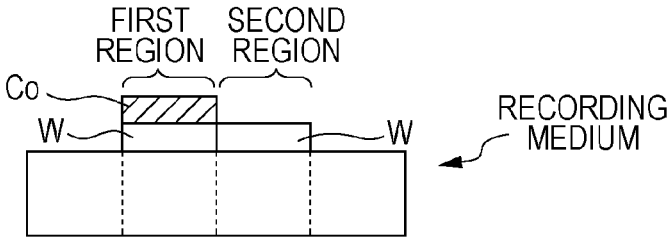

FIGS. 2A and 2B schematically show the recording medium to which the color image (Co) is recorded onto the background image (W) of the first region using the second image recording step. Specifically, FIG. 2A shows the upper face of the recording medium in which the color image (Co) is recorded onto the background image (W) of the first region. Further, FIG. 2B shows the cross-section along the line IIB-IIB of FIG. 2A.

In this manner, the color image (Co) formed from the color ink is recorded onto the background image (W) of the first region using the second image recording step.

1.3. Other Modes of Second Image Recording Step

In the second image recording step, in addition to the color ink, it is possible to discharge a resin ink (described below). That is, the second image recording step (A) may record the image by discharging a resin ink and the color ink at substantially the same time, such that they adhere onto the background ink of the first region (hereinafter, this step will also be referred to as the "mode (A) of the second image recording step).

In relation to the second image recording step, of a mode in which the color image (Co) formed from only the color ink is recorded, and a mode in which the color image (Co+Cl) formed from the color ink and the resin ink is recorded, which mode to select, for example, may be appropriately determined by the user.

In the invention, "at substantially the same time" means that the droplets of both one of the inks and the other are discharged at a such timing that it is possible for them to mix together. In addition, this includes a case in which one of the inks is discharged while the other ink is in a flowing state after landing on the recording medium. Specifically, "at substantially the same time" refers to forming one image using both one ink and the other ink within one scan (hereinafter, also referred to as "one pass") when using an ordinary ink jet recording apparatus of a type which performs discharging of the ink while scanning the nozzles in relation to the recording medium. Accordingly, in addition to a case in which both of the inks are discharged at exactly the same time, a case in which one of the inks is discharged and the other ink is subsequently discharged within one pass are also included in "at substantially the same time".

Figure 3A:
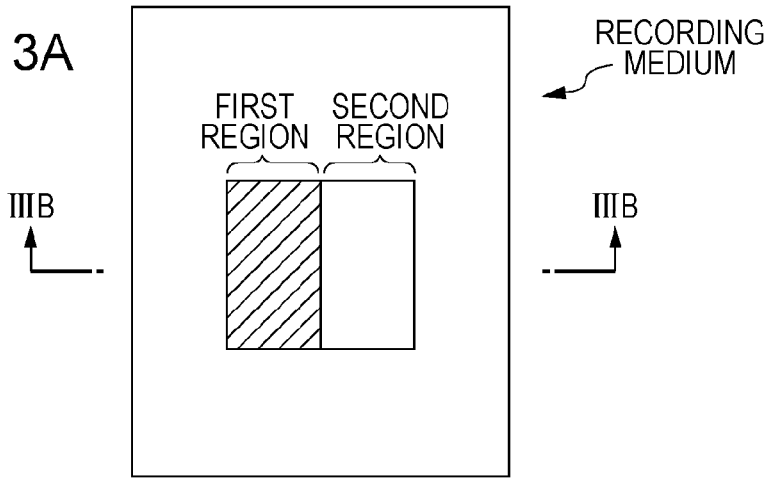
FIGS. 3A and 3B schematically show a recording medium to which a color image (Co+Cl) is recorded onto the background image (W) of the first region using a mode (A) of the second image recording step in the recording method according to the present embodiment.
Figure 3B:
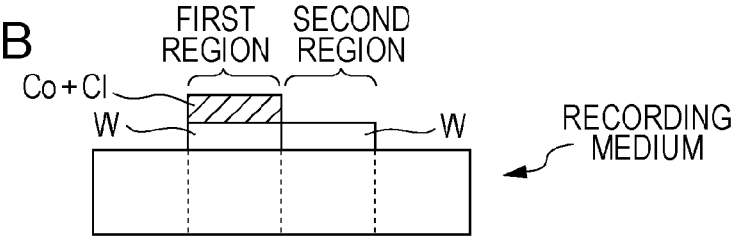

FIGS. 3A and 3B schematically show the recording medium to which the color image (Co+Cl) formed from the color ink and the resin ink is recorded onto the background image (W) of the first region using the mode (A) of the second image recording step. Specifically, FIG. 3A shows the upper face of the recording medium in which the color image (Co+Cl) is recorded onto the background ink of the first region. Further, FIG. 3B shows the cross-section along the line IIIB-IIIB of FIG. 3A.

In this manner, the color image (Co+Cl) formed from the color ink and the resin ink is recorded onto the background image (W) of the first region using the mode (A) of the second image recording step. When the color image is formed from the color ink and the resin ink, it is possible to improve the fixing properties of the color ink due to the resin contained in the resin ink.

While not illustrated, the mode (A) of the second image recording step may also include recording the image by making the resin ink land on the background ink (the background image (W)) of the second region. Accordingly, it is possible to form the image (Cl) formed from the resin ink on the background image (W) of the second region. In this manner, since it is possible to coat the background image (W) of the second region using the image (Cl) formed from the resin ink when the image (Cl) formed from the resin ink is formed on the background image (W) of the second region, it is possible to improve the fixing properties of the background image (W) formed on the second region.

It is possible to perform the recording of the color image (Co+Cl) to the first region and the recording of the image (Cl) formed from the resin ink to the second region during the same scan. Accordingly, since it is possible to reduce the number of feeds of the recording medium and the number of scans of the carriage, there is a case in which the printing speed can be improved.

1.4. Third Image Recording Step

The third image recording step (B) is performed after the second image recording step, and records the image by discharging the resin ink such that it adheres onto the color ink of the first region.

Figure 4A:
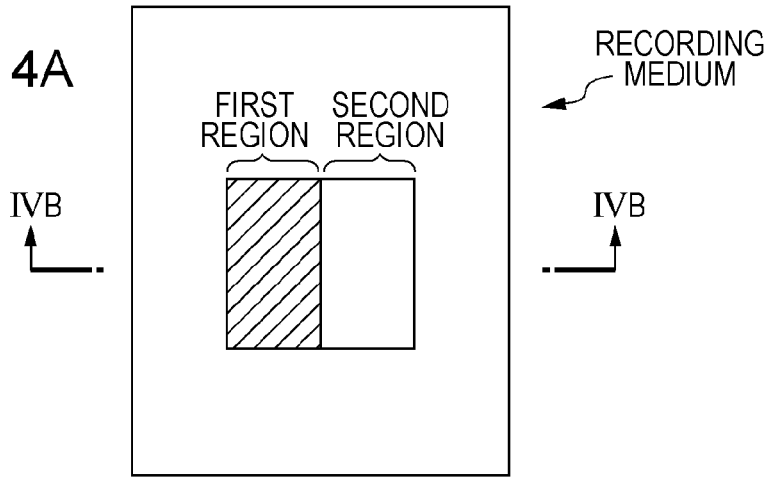
FIGS. 4A and 4B schematically show a recording medium to which an image (Cl) is recorded onto the color image (Co) of the first region using the third image recording step in the recording method according to the present embodiment.
Figure 4B:
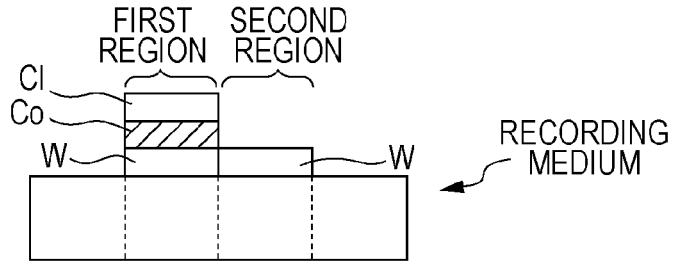

According to the third image recording step, as shown in FIGS. 4A and 4B, the image (Cl) formed from the resin ink is recorded onto the color image (Co) of the first region.

Here, FIGS. 4A and 4B schematically show the recording medium in which the image (Cl) formed from the resin ink is recorded onto the color image (Co) of the first region using the third image recording step. Specifically, FIG. 4A shows the upper face of the recording medium in which the image (Cl) formed from the resin ink is recorded onto the color image (Co) of the first region. Further, FIG. 4B shows the cross-section along the line IVB-IVB of FIG. 4A.

The third image recording step is necessary when the color image (Co) formed from only the color ink is recorded onto the background image (W) of the first region (that is, when the mode (A) of the second image recording step is selected). Since the color image (Co) formed from only the color ink tends to have poor fixing properties, the fixing properties of the color image (Co) can be improved by coating the color ink with the resin ink.

Meanwhile, when the mode (A) of the second image recording step is performed, the third image recording step is arbitrary. When performing the third image recording step after performing the mode (A) of the second image recording step, as shown in FIGS. 5A and 5B, the image (Cl) formed from the resin ink is recorded onto the color image (Co+Cl) of the first region.

Figure 5A:
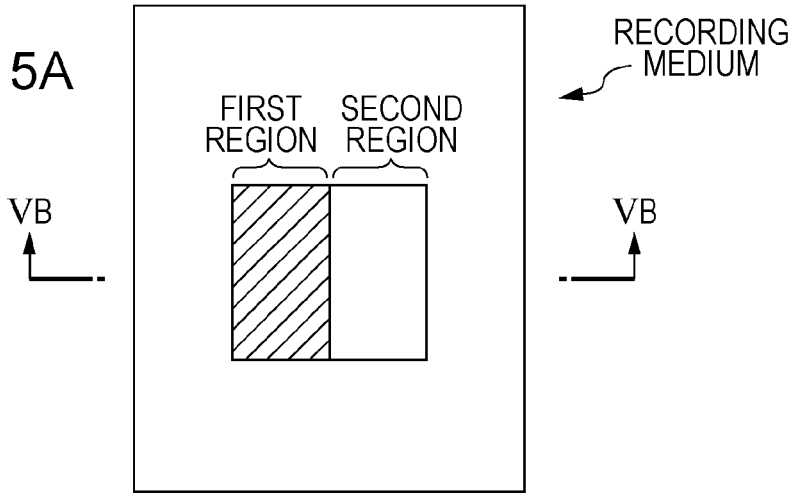
FIGS. 5A and 5B schematically show a recording medium to which the image (Cl) is recorded onto the color image (Co+Cl) of the first region using the third image recording step in the recording method according to the present embodiment.
Figure 5B:
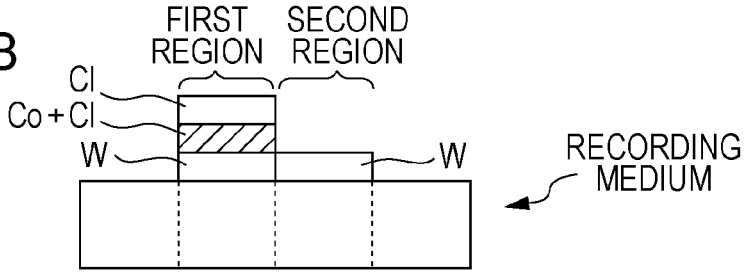

Here, FIGS. 5A and 5B schematically show the recording medium in which the image (Cl) formed from the resin ink is recorded onto the color image (Co+Cl) of the first region using the third image recording step. Specifically, FIG. 5A shows the upper face of the recording medium in which the image (Cl) formed from the resin ink is recorded onto the color image (Co+Cl) of the first region. Further, FIG. 5B shows the cross-section along the line VB-VB of FIG. 5A.

In this manner, when the image (Cl) formed from the resin ink is recorded onto the color image (Co+Cl) of the first region, the fixing properties of the color image (Co+Cl) are further improved.

While not illustrated, the third image recording step may also include recording the image by adhering the resin ink (described below) onto the background ink (the background image (W)) of the second region. Accordingly, it is possible to form the image (Cl) formed from the resin ink on the background image (W) of the second region. In this manner, since it is possible to coat the background image (W) of the second region using the image (Cl) formed from the resin ink when the image (Cl) formed from the resin ink is formed on the background image (W) of the second region, it is possible to improve the fixing properties of the background image (W) formed on the second region.

In the third image recording step, it is possible to perform the recording of the image (Cl) formed from the resin ink to the first region and the recording of the image (Cl) formed from the resin ink to the second region during the same scan. Accordingly, since it is possible to reduce the number of feeds of the recording medium and the number of scans of the carriage, there is a case in which the printing speed can be improved.

1.5. Heating Step

The heating step heats the recording medium to 35° C. to 100° C. The heating step dries the ink (the image) adhered onto the recording medium by heating the recording medium.

Since the fast evaporation and scattering of the liquid medium contained in the ink adhered to the printing medium is facilitated by the present step, the formation of the ink film is facilitated. Accordingly, it is possible to obtain in a short period of time, an image in which dry matter of the ink is strongly fixed (adhered) onto the recording medium.

Furthermore, in the present specification, the heating temperature, when heating the recording medium, refers to the temperature of the recording medium, more specifically, to the temperature of the recorded surface thereof. It is possible to measure the heating temperature using a thermograph obtained using the infrared thermography apparatus H2640/H2630 (manufactured by Nippon Avionics Co., Ltd.).

The heating timing of the recording medium is not particularly limited, as long as the above objective can be achieved. For example, the heating may be performed at a timing such as at least one of before, during, or after discharging the ink.

While not limited to the following, in an example of the heating before discharging the ink, for example, a heating unit is provided on the upstream side in the transport direction and the recording medium is preheated. In this case, the temperature of the recording surface of the recording medium when the ink is adhered thereto may be about 35° C. to 60° C.

While not limited to the following, in an example of the heating during discharging the ink, for example, the heating unit is provided beneath the region to which the ink is discharged from the head toward the recording medium (the opposite side of the recording medium when viewed from the transport surface), and discharging and landing (adhering) of the ink and heating of the recording medium are performed at the same time. In addition, from the perspective of the head, the heating unit may also be provided on the opposite side to the recording medium (above the head), and the recording medium may be heated.

While not limited to the following, in an example of the heating after discharging the ink, for example, the heating unit is provided on the downstream side in the transport direction and the recording medium to which the ink is adhered is heated.

Specific examples of the heating unit described above include a unit in which a platen heater is provided below the transport surface of the recording medium (the opposite side to the recording medium seen from the transport surface) to heat the recording medium from the opposite side to the recording surface, a unit in which a heating chamber or a thermostatic chamber through which the recording medium will be passed part way through the transporting is provided to heat the recording medium from various directions, and a unit in which a heater is provided above the transport surface of the recording medium to heat the recording medium from the recording surface side. In addition, while not limited to the following, examples of the type of heater, heating chamber and thermostatic chamber which contain a platen heater include, for example, a warm air heater, a hot air heater, and an infrared heater.

The heating temperature of the recording medium is 35° C. to 100° C. When the heating temperature is 35° C. or higher, it is possible to effectively promote the evaporation and scattering of the liquid medium in the ink, therefore the drying properties (the quick drying properties) of the ink are excellent. In addition, when the heating temperature is 100° C. or lower, it is possible to suppress the warping of the recording medium, and to suppress the contraction or the like of the image when heating and cooling the recording medium. In addition, in order to further increase the above described effects, the lower limit of the heating temperature is preferably 40° C. or higher, and is more preferably 60° C. or higher, meanwhile the upper limit of the heating temperature is preferably 100° C. or lower, and is more preferably 80° C. or lower.

In the ink jet recording method according to the present embodiment, it is possible to use any type of recording medium in accordance with demand. In particular, in the ink jet recording method according to the present embodiment, in addition to each of the steps described above, due to not substantially containing a pyrrolidone derivative with a standard boiling point of 240° C. or higher in at least one of the background ink and the color ink (described below), it is possible to record a good image also to an ink non-absorption or low-absorption recording medium in which the fixing properties and the drying properties of the ink are easily lowered.

In the invention, the term "ink non-absorption or low-absorption recording medium" represents "a recording medium in which the water absorption amount from the initiation of contact to the 30 $msec^{1/2}$ point is 10 $mL/m^2$ or less according to the Bristow method". The Bristow method is a method in the most widespread use as a measuring method of liquid absorption amount in a short time, and is also adopted by the Japan Technical Association of the Pulp and Paper Industry (JAPAN TAPPI). The details of the test method are disclosed in the standard No. 51 "Paper and Cardboard—Liquid Absorbency Test Method—Bristow Method" of the "JAPAN TAPPI Paper and Pulp Test Method 2000 Edition".

While not limited to the following, examples of the ink non-absorption recording medium include, for example, a plastic film which has not undergone surface treatment for ink jet recording (that is, an ink absorption layer has not been formed), or, a medium in which plastic is coated onto, or a plastic film is adhered to a substrate of paper or the like. While not particularly limited, examples of the plastic include, for example, polyvinyl chloride, polyethylene terephthalate, polycarbonate, polystyrene, polyurethane, polyethylene, and polypropylene.

While not limited to the following, examples of the ink low-absorption recording medium include, for example, actual printing stock such as art paper, coated paper and matte paper.

2. Ink Jet Recording Apparatus

The ink jet recording method according to the present embodiment is performed using an ink jet recording apparatus.

Description is given below with reference to the accompanying drawings in relation to an example of the ink jet recording apparatus to which the ink jet recording method according to the present embodiment can be applied. In each figure used in the following description, the scale of each member is appropriately changed to make each member a visually recognizable size. In the present embodiment, an ink jet printer (hereinafter, simply referred to as a "printer") is exemplified as the ink jet recording apparatus. Furthermore, this does not mean that the invention is limited to this apparatus configuration.

2.1. Apparatus Configuration

Figure 6:
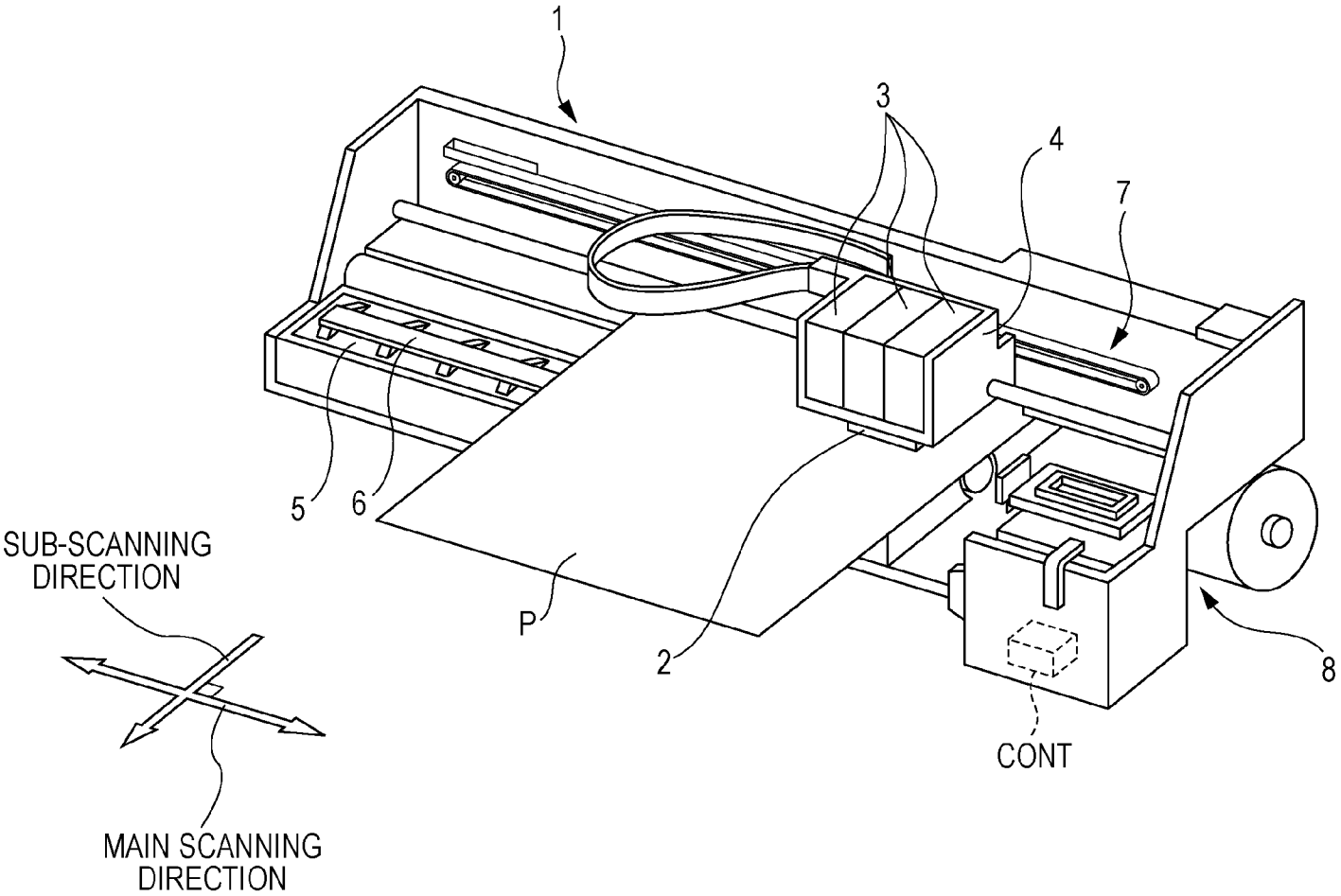
FIG. 6 is a perspective view showing the configuration of a printer to which the recording method according to the present embodiment can be applied.

FIG. 6 is a perspective view showing the configuration of a printer 1 in the present embodiment. The printer 1 shown in FIG. 6 is a serial printer. A serial printer is a printer in which an ink jet recording head (hereinafter, also simply referred to as a "head") is installed in a carriage which moves in a predetermined direction, and droplets are discharged onto the recording medium by the head moving together with the movement of the carriage.

As shown in FIG. 6, the printer 1 includes a carriage 4 on which a head 2 is mounted and an ink cartridge 3 is detachably mounted, a platen 5 on which a recording medium P arranged below the head 2 is transported, a heating mechanism 6 for heating the recording medium P, a carriage movement mechanism 7 which moves the carriage 4 in the medium width direction of the of the recording medium P, and a medium conveying mechanism 8 which transports the recording medium P in the medium conveying direction. In addition, the printer 1 includes a control unit CONT which controls the overall operation of the printer 1 and executes a plurality of modes. Here, the medium width direction described above is the main scanning direction (the head scanning direction). The medium conveying direction described above is the sub-scanning direction (the direction perpendicular to the main scanning direction).

The control unit CONT may include a command information reception unit that receives command information. The command information is output on the basis of an operation of an operation reception unit (for example, a touch panel operation button provided on a printer 20, or a keyboard or the like of the PC or the like connected to the printer 20) by the user, and is received by the command information reception unit. In addition, examples of the command information include, for example, an execution command or the like of each of the modes described below.

In addition, the control unit CONT may include a command execution unit which receives the command information output from the command information reception unit and performs an execution operation. The command execution unit can perform the execution operations which control or link the execution timing and the like of each of the operations of the carriage 4, the head 2, the carriage movement mechanism 7, the medium conveying mechanism 8, the heating mechanism 6 and the like, which are described above.

The head 2 turns the ink into droplets of a minute particle diameter, and discharges the droplets from a nozzle 17 to adhere them onto the recording medium P. The head 2 is not particularly limited, as long as it has the functions described above, and any ink jet recording system may be used. Examples of the ink jet recording system of the head 2 include, for example, a system in which an intense electric field is applied between acceleration electrodes placed on the nozzle and in front of the nozzle, the droplets of the ink are continually discharged from the nozzle, and recording is performed by applying a printing information signal to deflection electrodes during the period that the droplets of the ink fly between the deflection electrodes, or a system in which the droplets of the ink are discharged corresponding to the printing information signal without being deflected (an electrostatic adsorption system), a system in which the droplets of the ink are forcefully discharged by applying pressure to the ink droplets using a miniature pump and mechanically making the nozzle oscillate using a quartz oscillator or the like, a system in which pressure and the printing information signal are applied to the ink at the same time using a piezoelectric element to discharge and record the droplets of the ink (a piezo system), a system in which the ink is foamed by heating using microelectrodes in accordance with the printing information signal to discharge and record the ink droplets (a thermal jet system), or the like.

Figure 7:
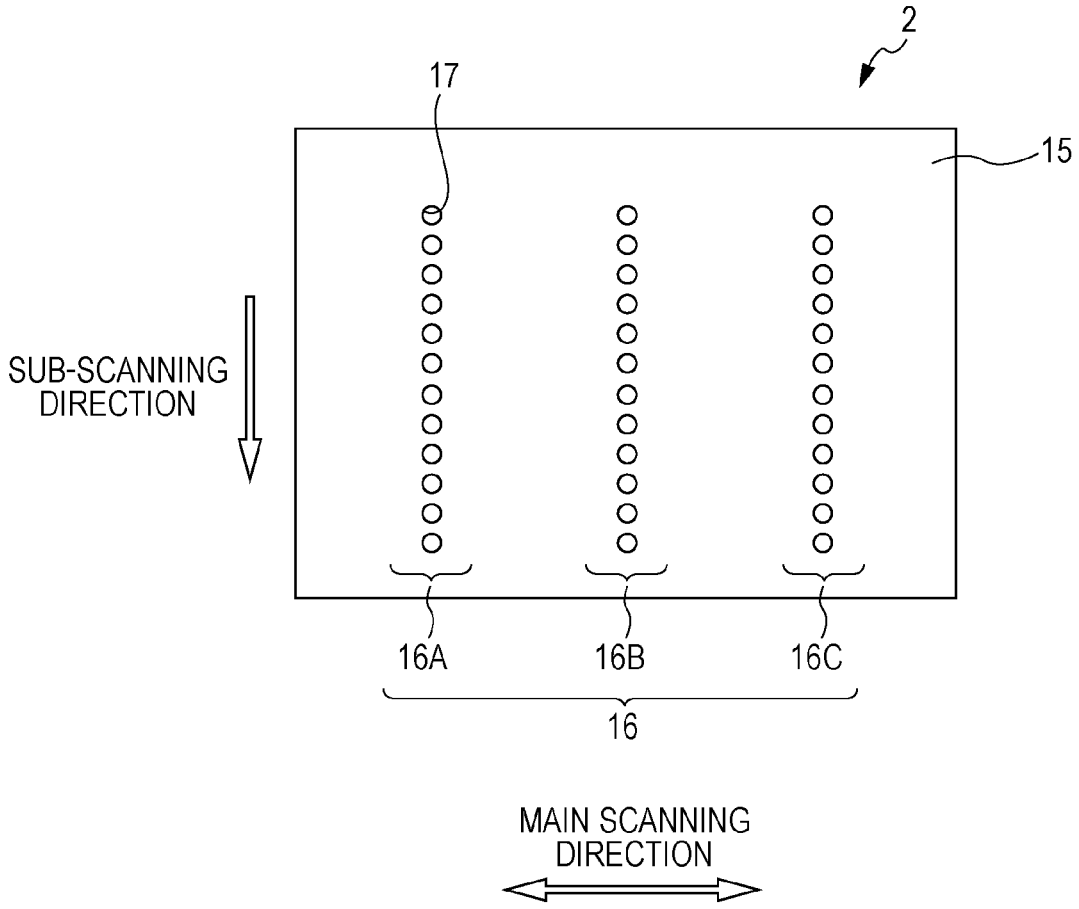
FIG. 7 schematically shows the nozzle face of the printer to which the recording method according to the present embodiment can be applied.

FIG. 7 schematically shows a nozzle face 15 of the head 2 according to the present embodiment. As shown in FIG. 7, the head 2 is provided with the nozzle face 15. On the nozzle face 15 which is also the discharge face of the ink, a plurality of nozzle rows 16 are arranged. In the plurality of nozzle rows 16, each of the nozzle rows has a plurality of nozzles 17 for discharging the ink.

In the plurality of nozzle rows 16, each of the nozzle rows is capable of discharging inks having different compositions, for example. In the example of FIG. 7, three nozzle rows are provided corresponding to the ink compositions, and each of the nozzle rows is arranged along the main scanning direction. Specifically, a nozzle row 16A capable of discharging the background ink, a nozzle row 16B capable of discharging the color ink, and a nozzle row 16C capable of discharging the resin ink are provided.

In the example of FIG. 7, the nozzle rows 16A to 16C each extend in the sub-scanning direction which is perpendicular to the main scanning direction on the nozzle face 15. However, the nozzle rows 16A to 16C are not limited thereto, and may also be arranged at an angle to the direction which is perpendicular to the main scanning direction within the nozzle face 15.

In the nozzle 17, the nozzle rows are formed by a plurality thereof being arranged in a predetermined pattern. In the present embodiment, a plurality of the nozzles 17 are arranged in a row in the sub-scanning direction of the nozzle face 15. However, the nozzles 17 are not limited thereto, and may also be arranged in a zigzag pattern along a direction perpendicular to the main scanning direction of the nozzle face 15, for example. Furthermore, the number of the nozzles 17 which configure the nozzle rows is not particularly limited.

Description was given centered on a serial head type printer (recording apparatus) as described above, however, the printer is not limited to this mode. Specifically, the printer may also be a line head type printer in which the recording heads are fixed and arranged sequentially in the sub-scanning direction, or a lateral type printer provided with a head (a carriage) provided with a moving mechanism which moves in the X direction and the Y direction (the main scanning direction and the sub-scanning direction) disclosed in Japanese Unexamined Patent Application Publication No. 2002-225255. For example, the Surepress L-4033A (manufactured by Seiko Epson Corp.) is a lateral type printer.

2.2. Modes

The ink jet recording apparatus according to the present embodiment executes a plurality of modes on the basis of the commands from the control unit. The term "mode" in the invention refers to the modes for recording a desired image onto the recording medium using the ink jet recording apparatus. Furthermore, the term "image" in the invention refers to a print pattern formed from a group of dots, which includes a text print and a solid print.

2.2.1. First Mode

The first mode records the image by discharging the background ink such that it adheres to the first region and the second region of the recording medium. That is, the first mode corresponds to the first image recording step, therefore detailed description will be omitted.

2.2.2. Second Mode

The second mode is a mode in which one of (a-1) or (a-2) below is selected and executed, and is executed after the first mode ends.

(a-1) is a mode in which the image is recorded by discharging the color ink such that it adheres onto the background ink of the first region. (a-1) corresponds to the second image recording step described above, therefore detailed description will be omitted.

Meanwhile, (a-2) is a mode in which the image is recorded by discharging the resin ink and the color ink at substantially the same time such that they adhere onto the background ink of the first region. (a-2) corresponds to the mode (A) of the second image recording step described above, therefore detailed description will be omitted. In addition, (a-2), in the same manner as in the mode (A) of the second image recording step, may also include recording the image by adhering the resin ink onto the background ink of the second region.

The choice between (a-1) and (a-2) in the second mode may be arbitrarily performed by the user using the operation reception unit described above, for example. Specifically, the control unit CONT makes the ink jet recording apparatus execute the command information on the basis of the command information output by the user operating the operation reception unit described above.

2.2.3. Third Mode

The plurality of modes may also include a third mode. The third mode is a mode in which one of (b-1) or (b-2) below is selected and executed, and is executed after the second mode ends.

(b-1) is a mode in which the image is recorded by discharging the resin ink such that it adheres onto the color ink of the first region. (b-1) corresponds to the third image recording step described above, therefore detailed description will be omitted. In addition, (b-1) may also include recording the image by adhering the resin ink onto the background ink of the second region.

Meanwhile, (b-2) is a mode in which the resin ink is not adhered onto the color ink of the first region. That is, (b-2) is a mode in which the image formed from the resin ink is not recorded onto the color image.

In addition, (b-1) and (b-2) may both also include recording the image by adhering the resin ink onto the background ink of the second region.

The choice between (b-1) and (b-2) in the third mode may also be arbitrarily performed by the user. However, when (a-1) is selected and executed in the second mode, it is preferable to store a command to select (b-1) in the control unit CONT in advance. This is because, when (b-2) is selected after executing (a-1), there is a case in which the fixing properties of the color image are insufficient.

2.2.4. Heating Mode

The plurality of modes include a heating mode in which the heating unit (the heating mechanism) heats the recording medium to 35° C. to 100° C. The heating mode corresponds to the heating step described above, therefore detailed description will be omitted. In the same manner as in the heating step described above, the timing at which the heating mode is executed is not particularly limited, as long as it is possible to dry the image on the recording medium.

3. Ink

In the ink jet recording method according to the present embodiment, the background ink, the color ink and the resin ink are used.

Of the inks used in the ink jet recording method according to the present embodiment, at least one of the background ink and the color ink does not substantially contain a pyrrolidone derivative with a standard boiling point of 240° C. or higher. Accordingly, even if the heating temperature of the recording medium is set to 35° C. to 100° C. in order to suppress the warping of the recording medium and the degradation of the image, it is possible to realize high-speed printing with excellent ink drying properties, and the fixing properties of the image are also excellent.

In particular, it is preferable that neither of the background ink and the color ink substantially contain a pyrrolidone derivative with a standard boiling point of 240° C. or higher. Accordingly, the drying properties of the recorded image further increase and it is possible to record an excellent image with little bleeding.

A 2-pyrrolidone (standard boiling point 245° C.) is an example of the pyrrolidone derivative with a standard boiling point of 240° C. or higher. Furthermore, the pyrrolidone derivatives do not include a polyvinyl pyrrolidone obtained by polymerizing pyrrolidone.

Furthermore, in the invention, the term "does not substantially contain A" means that A will not be intentionally added when manufacturing the ink, and it is not a concern even if a small amount of A unavoidably contaminates or is generated during the manufacture or the storage of the ink. Specific examples of "does not substantially contain" include, for example, containing no more than 1.0 mass %, preferably, containing no more than 0.5 mass %, more preferably, containing no more than 0.1 mass %, yet more preferably, containing no more than 0.05 mass %, and particularly preferably, containing no more than 0.01 mass %.

Below, detailed description will be given of the components contained in each of the inks.

3.1. Background Ink

The background inks used in the ink jet recording method according to the present embodiment contain a background color material. Examples of the background ink in the invention include, for example, white ink or glitter ink.

White ink is ink which can record a color which is generally accepted to be "white" and includes inks that contain trace amounts of colorant. In addition, this includes commercially available inks which contain a pigment and are referred to as "white ink" or other such names. Furthermore, for example, the inks include an ink in which, when the ink is recorded to Epson Genuine Photograph Paper (glossy) (manufactured by Seiko Epson Corp.) at a duty of 100% or more, or such that the surface of the photographic paper is coated with a sufficient amount of ink, and when the luminosity (L*) and the chromaticity (a*, b*) of the ink are measured using a spectrophotometer Spectrolino (trademark, manufactured by Global Imaging, Inc.) with the measuring conditions set to D50 light source, the observation range to 2°, the density to DIN NB, the reference white to Abs, the filter to No, and the measurement mode to Reflectance, the ink exhibits a range of $70 \leq L^* \leq 100$, $-4.5 \leq a^* \leq 2$, $-6 \leq b^* \leq 2.5$.

The term "glitter ink" refers to an ink which exhibits glitter when adhered to the medium. In addition, the term "glitter" refers to, for example, the property distinguished by the obtained specular gloss of the image (refer to the Japanese Industrial Standard (JIS) Z8741). For example, as the types of glitter, there are, a glitter in which light is reflected in a specular manner, a so-called matte glitter, and the like, and these may be respectively distinguished, for example, by the degree of specular gloss.

1. Background Color Material

Examples of the background color material include, for example, a white color material, and a glitter pigment.

Examples of the white color material include, for example, metallic oxides, barium sulfate and calcium carbonate. Examples of the metallic oxide include, for example, titanium dioxide, zinc oxide, silica, alumina and magnesium oxide. In addition, the white color material contains particles having a hollow structure. The particles having a hollow structure are not particularly limited, and a well-known example of such may be used. For example, the particles disclosed in the specification of U.S. Pat. No. 4,880,465 or the like may be favorably used as the particles having a hollow structure. As the white color material contained in the white ink of the present embodiment, among these, titanium dioxide is preferable from a viewpoint of the whiteness and the abrasion resistance.

When the white color material is used as the background color material, the content (the solid content) of the white color material in relation to the total mass of the white ink is preferably 1% to 20%, and is more preferably 5% to 15%. When the content of the white color material exceeds the above ranges, there is a case in which nozzle clogging and the like of the ink jet recording apparatus occurs. Meanwhile, when the content of the white color material is less than the above ranges, there is a tendency for the color density such as the whiteness to be insufficient.

The average particle diameter of the white color material on a volumetric basis (hereinafter referred to as "the average particle diameter") is preferably 30 nm to 600 nm, and is more preferably 200 nm to 400 nm. When the average particle diameter of the white color material exceeds the above ranges, there is a case in which the particles precipitate or the like and damage the dispersion stability, or nozzle clogging and the like occurs when applied to the ink jet recording apparatus. Meanwhile, when the average particle diameter of the white color material is smaller than the above ranges, there is a tendency for the whiteness to be insufficient.

The average particle diameter of the white color material may be measured by using a particle counter in which the principle of measurement is the laser diffraction scattering method. A particle size analyzer in which the principle of measurement is dynamic light scattering (for example, the "Microtrac UPA", manufactured by Nikkiso, Co., Ltd.) is an example of the particle counter.

While not limited to the following as long as the glitter pigment exhibits glitter when adhered to the medium, examples of the glitter pigment include, for example, an alloy of one, or two or more, types selected from a group including aluminum, silver, gold, platinum, nickel, chromium, tin, zinc, indium, titanium, and copper (also referred to as a metallic pigment), and a pearl pigment which has a pearl gloss. Representative examples of the pearl pigment include pigments having pearl gloss or interference gloss, such as titanium dioxide coated mica, scale foil, and bismuth acid chloride. In addition, the glitter pigment may also be surface treated to suppress the reaction with water. It is possible to form an image having excellent glitter by including the glitter pigment in the ink.

When the glitter pigment is used as the background color material, the content of the glitter pigment in relation to the total mass of the glitter ink is preferably 0.5 mass % to 30 mass %, and is more preferably 1 mass % to 15 mass %. When the content of the glitter pigment is within the above ranges, excellent discharge stability from the nozzles of the ink jet recording apparatus, and excellent storage stability of the glitter ink can be obtained.

2. Other Components

Resin

The background ink may contain a resin. One of the functions of the resin is to fix the background ink to the recording medium.

Examples of the resin include, for example, well-known resins such as acrylic-based resins, styrene acrylic-based resins, fluorine-based resins, urethane-based resins, polyolefin-based resins, rosin modified resins, terpene-based resins, polyester-based resins, polyamide-based resins, epoxy-based resins, vinyl chloride-based resins, vinyl chloride-vinyl acetate copolymers, and ethylene vinyl acetate resins; and polyolefin wax. One type of the resin may be used individually, or two or more types may be used together.

Among the resins exemplified above, the styrene acrylic-based resins, the polyester-based resins, and the polyolefin wax may be used favorably.

Commercially available polyester-based resins may be used, and examples thereof include, for example, Eastek 1100, 1300 and 1400 (trademarks, manufactured by Eastman Chemical Company, Japan), Elitel KA-5034, KA-3556, KA-1449, KT-8803, KA-5071S, KZA-1449S, KT-8701, and KT9204 (trademarks, manufactured by UNITIKA LTD.).

Examples of the styrene acrylic-based resins include, for example, a styrene-acrylic acid copolymer, a styrene-methacrylic acid copolymer, a styrene-methacrylic acid-acrylic acid ester copolymer, a styrene-α-methylstyrene-acrylic acid copolymer, and a styrene-α-methylstyrene-acrylic acid-acrylic acid ester copolymer. Furthermore, any of random copolymers, block copolymers, alternating copolymers, and graft copolymers may be used as the type of the copolymer. Furthermore, as the styrene acrylic-based resin, one that is commercially available may be used. Johncryl 62J (manufactured by BASF Japan Ltd.) is an example of a commercially available styrene acrylic-based resin.

While not particularly limited, examples of the polyolefin wax include, for example, olefins such as ethylene, propylene and butylene, or waxes and copolymers manufactured from the derivatives thereof, more specifically, a polyethylene-based wax, a polypropylene-based wax and a polybutylene-based wax. Among these, the polyethylene-based wax is preferable from a viewpoint of being able to reduce the occurrence of cracks in the image. One type of the polyolefin wax may be used individually, or two or more types may be used together.

Examples of commercially available polyolefin waxes include those in the CHEMIPEARL series such as "CHEMIPEARL W4005" (a polyethylene-based wax with a particle diameter of 200 nm to 800 nm, a ring and ball method softening point of 110° C., a penetration method hardness of 3 and a solid content of 40%, manufactured by Mitsui Chemicals, Inc.). Additional examples of commercially available polyolefin waxes include those in the AQUACER series such as AQUACER 513 (a polyethylene-based wax with a particle diameter of 100 nm to 200 nm, a melting point of 130° C. and a solid content of 30%), AQUACER 507, AQUACER 515 and AQUACER 840 (all of which are manufactured by Chemie Japan Co., Ltd.), those in the Hightech series such as Hightech E-7025P, Hightech E-2213, Hightech E-9460, Hightech E-9015, Hightech E-4A, Hightech E-5403P and Hightech E-8237 (all of which are manufactured by Toho Chemical Industry Co., Ltd.), and NOPCOTE PEM-17 (a polyethylene emulsion with a particle size of 40 nm, manufactured by SAN NOPCO LIMITED). These are commercially available in the form of water-based emulsion in which polyolefin wax is dispersed in water using a usual method. In the background ink according to the present embodiment, it is possible to directly add the polyolefin wax as it is, in the form of a water-based emulsion.

In a case in which the background ink contains a resin, the content (the amount in terms of solid content) of the resin in relation to the total mass of the background ink is preferably 1 mass % to 10 mass %, and is more preferably 1 mass % to 7 mass %. Due to the content of the resin contained in the background ink being within the above ranges, it is possible to suppress the occurrence of bleeding of the color image recorded onto the background image, since the drying properties of the background image are favorable.

In addition, when the background ink according to the present embodiment contains the resin, the total content of the resin and the background color material is preferably 9 mass % or more, and is more preferably 9 mass % to 31 mass %. When the total content of the resin and the background color material is 9 mass % or more, the image quality of the background image is satisfied. For example, when the ink is the white ink, the whiteness is satisfied, and when the ink is the glitter ink, the perceptible glitter is satisfied. Further, the background color material may be strongly fixed to the recording medium, and one or both of the color ink and the resin ink recorded onto the upper portion of the background image may be strongly adhered.

Organic Solvent

The background ink may contain an organic solvent. The background ink may also contain a plurality of types of organic solvent. Examples of the organic solvent used in the background ink include 1,2-alkane diols, polyhydric alcohols and glycol ethers.

Examples of the 1,2-alkane diols include, for example, 1,2-propanediol, 1,2-butanediol, 1,2-pentanediol, 1,2-hexanediol and 1,2-octanediol. Since the 1,2-alkane diols increase the wettability of the ink in relation to the recording medium and have an excellent uniform wetting action, it is possible to form an excellent image on the recording medium. When the background ink contains 1,2-alkane diols, the content in relation to the total mass of the background ink is preferably 1 mass % to 20 mass %.

Examples of the polyhydric alcohols include, for example, ethylene glycol, diethylene glycol, propylene glycol, dipropylene glycol, 1,3-propanediol, 1,3-butanediol, 1,3-pentanediol, 1,4-butanediol, 1,5-pentanediol, 1,6-hexanediol, 2,3-butanediol, 3-methyl-1,3-butanediol, 3-methyl-1,5-pentanediol, 2-methyl-1,3-propanediol, 2,2-dimethyl-1,3-propanediol, 2-methyl-2,4-pentanediol and glycerin. The polyhydric alcohols may be favorably used from the viewpoint of being capable of suppressing drying and hardening of the ink in the nozzle face of the head and of reducing nozzle clogging, discharging defects, or the like. When the background ink contains the polyhydric alcohols, the content in relation to the total mass of the background ink is preferably 2 mass % to 20 mass %.

Examples of the glycol ethers include, for example, ethylene glycol mono-isobutyl ether, ethylene glycol mono-hexyl ether, ethylene glycol mono-iso-hexyl ether, diethylene glycol mono-hexyl ether, triethylene glycol mono-hexyl ether, diethylene glycol mono-iso-hexyl ether, triethylene glycol mono-iso-hexyl ether, ethylene glycol mono-iso-heptyl ether, diethylene glycol mono-iso-heptyl ether, triethylene glycol mono-iso-heptyl ether, ethylene glycol mono-octyl ether, ethylene glycol mono-iso-octyl ether, diethylene glycol mono-iso-octyl ether, triethylene glycol mono-iso-octyl ether, ethylene glycol mono-2-ethylhexyl ether, diethylene glycol mono-2-ethylhexyl ether, triethylene glycol mono-2-ethylhexyl ether, diethylene glycol mono-2-ethylpentyl ether, ethylene glycol mono-2-ethylpentyl ether, ethylene glycol mono-2-ethylhexyl ether, diethylene glycol mono-2-ethylhexyl ether, ethylene glycol mono-2-methylpentyl ether, diethylene glycol mono-2-methylpentyl ether, propylene glycol monobutyl ether, dipropylene glycol monobutyl ether, tri-propylene glycol monobutyl ether, propylene glycol monopropyl ether, dipropylene glycol monopropyl ether and tripropylene glycol monomethyl ether. One type of these may be used individually, or a mixture of two or more types may be used. The glycol ethers can control the wettability and the permeation rate of the ink in relation to the recording medium. Therefore, it is possible to record a vivid image having little density unevenness. When the ink contains glycol ethers, the content in relation to the total mass of the ink is preferably 0.05 mass % to 6 mass % from a viewpoint of improving the wettability and the permeability to the recording medium to reduce density unevenness, improving the storage stability and the discharge reliability of the ink, and the like.

Surfactant

The background ink of the present embodiment may also contain a surfactant. While not limited to the following, a nonion-based surfactant is an example of the surfactant. The nonion-based surfactant has an effect of evenly spreading the ink on the recording medium. Therefore, when ink jet recording is performed using an ink containing the nonion-based surfactant, a high definition image with very little bleeding may be obtained.

While not limited to the following, examples of the nonion-based surfactant include, for example, acetylene glycol-based, silicone-based, polyoxyethylene alkyl ether-based, polyoxypropylene alkyl ether-based, polycyclic phenyl ether-based, sorbitan derivative and fluorine-based surfactants. Among these, it is preferable to use at least one of the acetylene glycol-based surfactant and the silicone-based surfactant.

In comparison to the other nonion-based surfactants, the acetylene glycol-based surfactant has an excellent ability to suitably secure the surface tension and the interfacial tension, and, very little foaming occurs. Accordingly, the ink containing the acetylene glycol-based surfactant can suitably secure the interfacial tension and the surface tension of printer members that make contact with the ink of the nozzle face or the like of the head. Therefore, by using the ink containing the acetylene glycol-based surfactant in the ink jet recording system, it is possible to improve the discharging stability. In addition, since the acetylene glycol-based surfactant exhibits a favorable affinity (wettability) and permeability in relation to the recording medium, the image recorded using an ink containing it is high definition and has very little bleeding.

While not particularly limited, examples of the acetylene glycol-based surfactant include, for example, Surfynol 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, GA and DF110D (all trademarks, manufactured by Air Products and Chemicals. Inc), Olfine B, Y, P, A, STG, SPC, E1004, E1010, PD-001, PD-002W, PD-003, PD-004, EXP. 4001, EXP. 4036, EXP. 4051, AF-103, AF-104, AK-02, SK-14 and AE-3, (all trademarks, manufactured by Nissin Chemical Industry Co., Ltd.), Acetylenol E00, E00P, E40 and E100, (all trademarks, manufactured by Kawaken Fine Chemicals Co., Ltd.). One type of the acetylene glycol-based surfactant may be used individually, or two or more types may be used together.

When the ink contains the acetylene glycol-based surfactant, the content in relation to the total mass of the ink is preferably 0.1 mass % to 3 mass %.

In comparison to the other nonion-based surfactants, the silicone-based surfactant has an excellent effect of evenly spreading the ink on the recording medium such that bleeding does not occur.

While not particularly limited, a polysiloxane-based compound is a favorable example of the silicone-based surfactant. While not particularly limited, a polyether-modified organosiloxane is an example of the polysiloxane-based compound. Commercially available examples of the polyether-modified organosiloxane include, for example, BYK-306, BYK-307, BYK-333, BYK-341, BYK-345, BYK-346 and BYK-348 (trademarks, manufactured by BYK), KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (trademarks, manufactured by Shin-Etsu Chemical Co., Ltd.). One type of the silicone-based surfactant may be used individually, or two or more types may be used together.

When the ink contains the silicone-based surfactant, the content in relation to the total mass of the ink is preferably 0.1 mass % to 3 mass %.

Water

The background ink according to the present embodiment may also contain water. In particular, when the ink is an aqueous ink, water is the main medium, and is also the component which evaporates and scatters through drying.

Examples of the water include, for example, pure water such as ion-exchanged water, ultrafiltered water, reverse osmosis water, and distilled water. Another example is water in which as many ionic impurities have been removed as possible, such as ultrapure water. In addition, when water sterilized by ultraviolet irradiation, the addition of hydrogen peroxide, or the like is used, it is possible to prevent the occurrence of mold and bacteria when the pigment dispersion and the ink using the same are kept in long-term storage.

Other Components

In addition to the components described above, the background ink according to the present embodiment may further include a pH adjustment agent such as potassium hydroxide, triethanolamine, a chelating agent such as ethylenediamine tetraacetate (EDTA), antiseptics, fungicides, and corrosion inhibitors.

3.2. Color Ink

The color ink according to the present embodiment contains a color material other than the background color material described above. 1. Color Material Other than Background Color Material Examples of the color material other than the background color material include, for example, a dye and a pigment. The content of the color material in relation to the total mass of the color ink is preferably 1 mass % to 20 mass % and is more preferably 1 mass % to 15 mass %.

For the dye and the pigment, those which are disclosed in U.S. Patent Application Publication Nos. 2010/0086690, 2005/0235870, International Publication No. WO 2011/027842, and the like may be used favorably. Of the dye and the pigment, it is more preferable for the color ink to contain the pigment. The pigment is preferably an organic pigment from a viewpoint of storage stability such as light resistance, weather resistance, gas resistance.

Specific examples of the pigment used include, azo pigments such as insoluble azo pigments, condensed azo pigments, azo lake, and chelate azo pigments; polycyclic pigments such as phthalocyanine pigments, perylene and perylene pigments, anthraquinone pigments, quinacridone pigments, dioxazine pigments, thioindigo pigments, isoindolinone pigments, and quinophthalone pigments; and chelate dyes, lake dyes, nitro pigments, nitroso pigments, aniline black, daylight fluorescent pigments and carbon black. One type of the pigment may be used individually, or two or more types may be used together.

In addition, examples of the dies that may be used include, for example, the various types of dye which are normally used in ink jet recording such as direct dyes, acid dyes, food dyes, basic dyes, reactive dyes, disperse dyes, vat dyes, soluble vat dyes and reactive dispersed dye.

2. Resin

The color ink may contain a resin. Examples of the function of the resin include, for example, fixing the color ink to the recording medium and improving the dispersibility of the color material inside the color ink.

The content of the resin in relation to the total mass of the color ink is preferably 0.1 mass % to 10 mass % and is more preferably 1 mass % to 7 mass %. When the content of the resin in the color ink is within the ranges described above, the functions of the resin are favorably exhibited.

Since the resin exemplified in the above description of the background ink can be used as the resin contained in the color ink, the description will be omitted.

In addition, when the color ink according to the present embodiment contains the resin, the total content of the resin and color material other than the background color material is preferably 9 mass % or more, and is more preferably 9 mass % to 31 mass %. When the total content of the resin and the color material other than the background color material is 9 mass % or more, the color development of the color ink, for example, the color development of the color ink when using a low absorption recording medium is satisfied. Further, the color ink may be strongly adhered to the background ink and the resin ink.

3. Other Components

The color ink may contain other components than those described above. Since the components which can be used in the color ink are the same as those exemplified in "3.1.2. Other Components", description will be omitted.

3.3. Resin Ink

The resin ink according to the present embodiment contains a resin and does not substantially contain a color material. Since the resin ink according to the present embodiment does not substantially contain a color material, the resin ink is a colorless and transparent liquid, or a colorless and semi-transparent liquid.

The resin ink according to the present embodiment is mainly used in order to improve the fixing properties of the background image and the color image.

Below, detailed description will be given of the components contained in the resin ink.

1. Resin

The resin ink contains a resin. An example of one of the functions of the resin is to fix the resin ink to the recording medium.

The content of the resin in relation to the total mass of the resin ink is preferably 1 mass % to 15 mass % and is more preferably 5 mass % to 10 mass %. When the content of the resin in the resin ink is within the above ranges, the functions of the resin are favorably exhibited.

Since the resin exemplified in the above description of the background ink can be used as the resin contained in the resin ink, the description will be omitted.

2. Other Components

The resin ink may contain other components than those described above. Since the components which can be used in the resin ink are the same as those exemplified in "3.1.2. Other Components", description will be omitted.

3.4. Manufacturing Method of Ink

Each of the inks according to the present embodiment (the background ink, the color ink and the resin ink) is obtained by mixing the components (the materials) described above in an arbitrary order, performing filtration as necessary and removing impurities. Here, when adding the pigment, it is preferable to perform the mixing after preparing the pigment in advance to be in a uniformly dispersed state in the solvent, since this simplifies the handling.

An example of a mixing method of each of the materials which is favorably used is a method in which the materials are sequentially added to a container provided with a stirring apparatus such as a mechanical stirrer or a magnetic stirrer and then mixed by stirring. As the filtration method, for example, centrifugal filtration, filter filtration, or the like may be performed as necessary.

3.5. Physical Properties of Ink

The viscosity at 20° C. of each of the inks according to the present embodiment is preferably 2 mPa·s to 10 mPa·s, and is more preferably 3 mPa·s to 6 mPa·s. When the ink has a viscosity within the above ranges at 20° C., since it is possible to discharge an appropriate amount of the ink from the nozzles and further reduce the occurrences of flight bending or scattering, the ink may be favorably used in the ink jet recording apparatus. The viscosity of the ink may be measured by using a vibration type viscometer VM-100AL (manufactured by Yamaichi Electronics Co., Ltd.) and maintaining the temperature of the ink at 20° C.

4. Examples

Below, specific description will be given of the invention using examples and comparative examples; however, the invention is not limited to these examples.

4.1. Preparation of Each Ink

Each of the components was mixed by stirring in the blending quantities shown in Table 1 to Table 4, filtered using a metal filter having a pore diameter of 5 μm and deaerated using a vacuum pump. Thereby, the background ink (W ink), the color ink (Co ink) and the resin ink (Cl ink) used in the evaluations below were prepared.

Furthermore, a pigment dispersion, in which the pigment (the color material) was dispersed in advance, was used in the preparation of the color ink. The pigment dispersion was prepared in the following manner. First, a 2000 ml separable flask provided with a stirring apparatus, a reflux pipe, a temperature sensor and a dropping funnel was sufficiently nitrogen purged, 200.0 parts by mass of diethylene glycol monomethyl ether were subsequently placed into the separable flask and heated to 80° C. while stirring. Next, 200.0 parts by mass of diethylene glycol monomethyl ether, 483.0 parts by mass of cyclohexyl acrylate (hereinafter referred to as "CHA"), 66.6 parts by mass of methacrylic acid (hereinafter referred to as "MAA"), 50.4 parts by mass of acrylic acid (hereinafter referred to as "AA") and 4.8 parts by mass of t-butylperoxy (2-ethylhexanoate) (hereinafter referred to as "BPEH") were placed into the dropping funnel and dropped into the separable flask for four hours at 80° C. After the dropping, the solution was maintained at 80° C. for one hour, 0.8 parts by mass of the BPEH were subsequently added and the solution was further allowed to react at 80° C. for one hour. After the solution finished maturing, the diethylene glycol monomethyl ether was removed using distillation under reduced pressure. Subsequently, 600.0 parts by mass of methyl ethyl ketone (hereinafter referred to as "MEK") were added and a polymer composition solution for ink jet ink with a resin solid content of 50% was obtained. A portion of the polymer composition solution for ink jet ink obtained in this manner was taken and dried for one hour at 105° C. using an ignition drying oven, and the subsequently obtained solid content of the polymer composition for ink jet ink had an acid value of 130 mg/KOH/g and a weight-average molecular weight of 34,000. Next, 6.0 parts by mass of a 30% sodium hydroxide aqueous solution were added in relation to 120.0 parts by mass of the polymer composition solution for ink jet ink, the solution was stirred for five minutes using a high-speed disperser, 480.0 parts by mass of a dispersion containing a cyan pigment (or a black pigment) having a pigment density of 25 mass % were further added, the solution was stirred for one hour using the high-speed disperser and a pigment dispersion was obtained.

Furthermore, a titanium dioxide dispersion, in which titanium dioxide (the background color material) was dispersed in advance, was used in the preparation of the background ink. The titanium dioxide dispersion was prepared in the following manner. First, 25 parts by mass of a solid acrylic acid/n-butyl acrylate/benzyl methacrylate/styrene copolymer having a glass transition temperature of 40° C., a mass-average molecular weight of 10,000 and an acid value of 150 mg KOH/g were dissolved into a mixed solution having 75 parts by mass of diethylene glycol diethyl ether, and a polymeric dispersant solution having a resin solid content of 25 mass % was obtained. Next, 19 mass % of the diethylene glycol diethyl ether was added to 36 mass % of the polymeric dispersant solution and mixed to prepare a resin varnish for titanium dioxide dispersion, 45 mass % of titanium dioxide (manufactured by C.I. Kasei Co., Ltd., trademark "NanoTek® Slurry", a slurry containing a proportion of 15% solid content density titanium dioxide particles having an average particle diameter of 300 nm) was further added, the solution was mixed by stirring, was subsequently ground using a wet process circulation mill and the titanium dioxide dispersion was obtained.

The units of measurement of the ink compositions in Table 1 to Table 4 are all mass %, and they all represent solid content converted values in relation to the titanium dioxide pigment and the resin. The components denoted in Table 1 to Table 4 are as follows.

Color Material

Titanium dioxide pigment (manufactured by C.I. Kasei Co., Ltd., trademark "NanoTek® Slurry", a slurry containing a proportion of 15% solid content density titanium dioxide particles having an average particle diameter of 300 nm)

Cyan pigment (C.I. pigment blue 15:3)

Black pigment (C.I. pigment black 7)

Resin

Styrene acrylic-based resin (manufactured by BASF Japan Ltd., trademark "Johncryl 62J")

Polyethylene-based wax (manufactured by Chemie Japan Co., Ltd., trademark "AQUAUCER 513", average particle diameter of 150 nm)

Other Components

Silicone-based surfactant (manufactured by Chemie Japan Co., Ltd., trademark "BYK-348")

Acetylene glycol-based surfactant (manufactured by Nissin Chemical Industry Co., Ltd., trademark "Surfynol DF110D")

1,2-hexane diol 1,3-butanediol 2-pyrrolidone propylene glycol

Ion-exchanged water 4.2. Ink Jet Printer

In the following evaluation test, as the ink jet recording apparatus, a PX-G930 ink jet printer (trademark, manufactured by Seiko Epson Corp., nozzle resolution: 180 dpi) which was modified by attaching a heater capable of changing the temperature of the paper guide portion was used.

Next, a dedicated ink cartridge for the ink jet printer (manufactured by Seiko Epson Corp., product name "PX-G930") was filled with the W ink, the Co ink and the Cl ink disclosed in Table 1 to Table 4, respectively, and the ink cartridge was mounted to the modified printer.

Furthermore, the ink discharge amount of the printer was set to, in relation to a duty of 100%, an ink discharge amount of 9 mg/inch$^2$.

In the present specification, the term "duty value" refers to the value calculated using the formula below.

$$\text{duty}(\%)=\text{actual number of dots discharged}/(\text{vertical resolution}\times\text{horizontal resolution})\times 100$$

(where, in the formula, the "actual dots discharged" is the actual dots discharged per unit area, and each of the "vertical resolution" and the "horizontal resolution" is a resolution per unit area)

4.3. Evaluation test 4.3.1. Creation of Evaluation Test Sample

The evaluation test sample of the examples and the comparative examples was created using the modified PX-G930 ink jet printer, using one of the following recording methods. The recording methods are recording method (I), recording method (II) and recording method (III). Furthermore, all of the images (the images including the background image, the color image and the resin ink) recorded during each of the steps were set to be solid patterns of a resolution of 1440×720 dpi. The duty values during the recording of each of the images are shown together in Table 1 to Table 4. In addition, LUMIRROR® S10-100 μm (manufactured by Toray Industries, Inc., transparent PET film) was used for the recording medium.

Recording Method (I)

Figure 8:
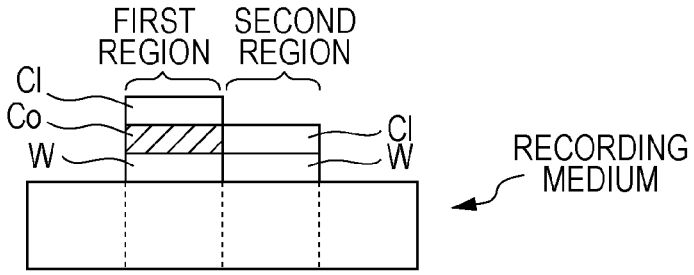
FIG. 8 schematically shows the cross-section of the image obtained using the recording method (I) in the example.

FIG. 8 schematically shows the cross-section of the image obtained using the recording method (I).

In the recording method (I), first, the surface temperature of the recording medium was set to 45° C. using the heater provided on the printer. Then, the background image (W) formed from the background ink was recorded onto the first region and the second region of the recording medium in the same manner as in the first image recording step described above. Next, the color image (Co) formed from the color ink was recorded onto the background ink of the first region in the same manner as in the second image recording step. Then, the image (Cl) formed from the resin ink was recorded onto the color image (Co) of the first region in the same manner as in the third image recording step described above, and the image (Cl) formed from the resin ink was recorded onto the background image (W) of the second region during the same scan. Subsequently, the obtained evaluation test sample was left in a thermostatic chamber maintained at 50° C. for 10 minutes.

The image shown in FIG. 8 was obtained in this manner.

Recording Method (II)

Figure 9:
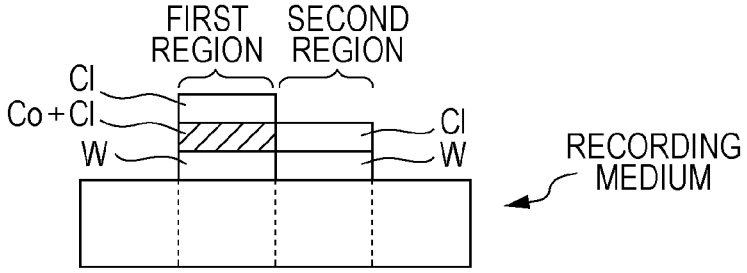
FIG. 9 schematically shows the cross-section of the image obtained using the recording method (II) in the example.

FIG. 9 schematically shows the cross-section of the image obtained using the recording method (II).

In the recording method (II), first, the surface temperature of the recording medium was set to 45° C. using the heater provided on the printer. Then, the background image (W) formed from the background ink was recorded onto the first region and the second region of the recording medium in the same manner as in the first image recording step described above. Next, the color image (Co+Cl) formed from the color ink and the resin ink was recorded onto the background ink of the first region in the same manner as in the mode (A) of the second image recording step. Then, the image (Cl) formed from the resin ink was recorded onto the color image (Co+Cl) of the first region in the same manner as in the third image recording step described above, and the image (Cl) formed from the resin ink was recorded onto the background image (W) of the second region during the same scan of the head. Subsequently, the obtained evaluation test sample was left in a thermostatic chamber maintained at 50° C. for 10 minutes.

The image shown in FIG. 9 was obtained in this manner.

Recording Method (III)

Figure 10:
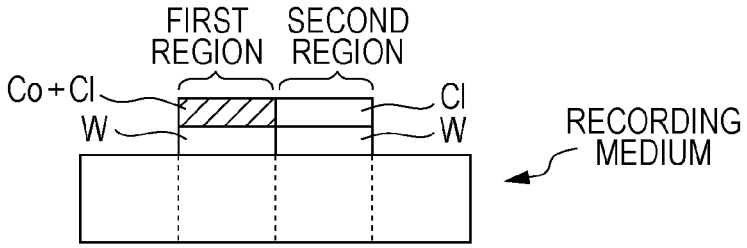
FIG. 10 schematically shows the cross-section of the image obtained using the recording method (III) in the example.

FIG. 10 schematically shows the cross-section of the image obtained using the recording method (III).

In the recording method (III), first, the surface temperature of the recording medium was set to 45° C. using the heater provided on the printer. Then, the background image (W) formed from the background ink was recorded onto the first region and the second region of the recording medium in the same manner as in the first image recording step described above. Next, the color image (Co+Cl) formed from the color ink and the resin ink was recorded onto the background ink of the first region in the same manner as in the mode (A) of the second image recording step described above, and the image (Cl) formed from the resin ink was recorded onto the background image (W) of the second region during the same scan of the head. Subsequently, the obtained evaluation test sample was left in a thermostatic chamber maintained at 50° C. for 10 minutes.

The image shown in FIG. 10 was obtained in this manner.

4.3.2. Concealment Evaluation Test

The obtained evaluation test sample was held up to a fluorescent lamp, and the fluorescent lamp was visually observed through the evaluation test sample. The evaluation of the concealment of the image on the second region was performed according to the visibility of the fluorescent lamp at this time.

The evaluation criteria are as follows.

A: the shape of the fluorescent lamp is not visible

B: the shape of the fluorescent lamp is barely visible

C: the shape of the fluorescent lamp is clearly visible 4.3.3. Adhesion Evaluation Test In accordance with JIS K5600-5-6, cross cutting was performed on the obtained image, and from the results of a peeling test using cellophane tape, the adhesion of the image on the first region and the second region was evaluated.

The evaluation criteria are as follows.

A: image peeling does not occur

B: less than 30% of the image peels

C: 30% or more of the image peels 4.3.4. Drying Properties Evaluation Test

The drying properties of the image were evaluated by rubbing the surface of the image recorded onto the evaluation test sample with a finger directly after removing the sample from a thermostatic chamber maintained at 50° C.

The evaluation criteria are as follows.

A: even if the image is rubbed strongly with a finger, the finger is not stained B: the finger is lightly stained when the image is rubbed strongly, however, the staining is not significantly visible C: when the image is rubbed with the finger, the finger is stained 4.3.5. Color Development Evaluation The color development was evaluated in relation to the evaluation test samples of example 8 to example 12. The same recording method as described above was used to obtain the color development evaluation test samples, except that the recording medium was changed to high quality paper (trademark "55PW8R", manufactured by Lintec Corporation).

The optical density (the OD value) of the image recorded on the first region of the obtained evaluation test sample was measured and the color development was evaluated on the basis of this value. A portable reflection density meter RD-19T (trademark, manufactured by Sakata Inx Eng. Co. Ltd.) was used to measure the optical density.

The evaluation criteria are as follows.

A: O.D. value is more than 2.0

B: O.D. value is 1.5 to 2.0

C: O.D. value is less than 1.5

4.4. Evaluation Result

The evaluation results of the above evaluation tests are shown in Table 1 to Table 4.

TABLE 1

| | | Example 1 | | | Example 2 Type of Ink | | | Example 3 | | |
|---|---|---|---|---|---|---|---|---|---|---|
| | | W ink | Co Ink | Cl Ink | W ink | Co Ink | Cl Ink | W ink | Co Ink | Cl Ink |
| Ink Composition | titanium dioxide pigment | 10% | | | 10% | | | 10% | | |
| | cyan pigment | | 4% | | | 4% | | | 4% | |
| | styrene acrylic-based resin | 5% | 1% | 6% | 5% | 1% | 6% | 5% | 1% | 6% |
| | polyethylene-based wax | 1% | 1% | 2% | 1% | 1% | 2% | 1% | 1% | 2% |
| | 1,2-hexanediole 2-pyrrolidone | 5% | 5% | 5% | 5% | 5% | 5% | 5% | 5% | 5% |
| | silicone-based surfactant | 1% | 1% | 1% | 1% | 1% | 1% | 1% | 1% | 1% |
| | acetylene glycol-based surfactant | 0.5% | 0.5% | 0.5% | 0.5% | 0.5% | 0.5% | 0.5% | 0.5% | 0.5% |
| | propylene glycol | 10% | 10% | 14% | 10% | 10% | 14% | 10% | 10% | 14% |
| | ion-exchanged water | residual quantity | residual quantity | residual quantity | residual quantity | residual quantity | residual quantity | residual quantity | residual quantity | residual quantity |
| | Total | 100% | 100% | 100% | 100% | 100% | 100% | 100% | 100% | 100% |
| Recording Conditions | Recording Method | | (I) | | | (II) | | | (III) | |
| | Duty | 150% | 100% | 20% | 150% | 50% | 20% | 150% | 50% | 20% |
| Test Results | White Concealment | A | — | | A | — | | A | — | |
| | Adhesion (W, or Co on W) | A | A | | A | A | | A | A | |
| | Drying Properties | | A | | | A | | | A | |

TABLE 2

| | | Example 4 | | | Example 5 | | | Example 6 | | | Example 7 | | |
|---|---|---|---|---|---|---|---|---|---|---|---|---|---|
| | | Type of Ink | | | | | | | | | | | |
| | | W ink | Co Ink | Cl Ink | W ink | Co Ink | Cl Ink | W ink | Co Ink | Cl Ink | W ink | Co Ink | Cl Ink |
| Ink Composition | titanium dioxide pigment | 10% | | | 10% | | | 10% | | | 10% | | |
| | cyan pigment | | 4% | | | 4% | | | 4% | | | 4% | |
| | styrene acrylic-based resin | 5% | 1% | 6% | 5% | 1% | 6% | 5% | 1% | 6% | 5% | 1% | 6% |
| | polyethylene-based wax | 1% | 1% | 2% | 1% | 1% | 2% | 1% | 1% | 2% | 1% | 1% | 2% |
| | 1,2-hexanediole | 5% | 5% | 5% | 5% | 5% | 5% | 5% | 5% | 5% | 5% | 5% | 5% |
| | 2-pyrrolidone | | 4% | 4% | | | 4% | 4% | | | | 4% | |
| | silicone-based surfactant | 1% | 1% | 1% | 1% | 1% | 1% | 1% | 1% | 1% | 1% | 1% | 1% |
| | acetylene glycol-based surfactant | 0.5% | 0.5% | 0.5% | 0.5% | 0.5% | 0.5% | 0.5% | 0.5% | 0.5% | 0.5% | 0.5% | 0.5% |
| | propylene glycol | 10% | 10% | 14% | 10% | 10% | 14% | 10% | 10% | 14% | 10% | 10% | 14% |
| | ion-exchanged water | residual quantity | residual quantity | residual quantity | residual quantity | residual quantity | residual quantity | residual quantity | residual quantity | residual quantity | residual quantity | residual quantity | residual quantity |
| | Total | 100% | 100% | 100% | 100% | 100% | 100% | 100% | 100% | 100% | 100% | 100% | 100% |
| Recording Conditions | Recording Method | | (II) | | | (II) | | | (II) | | | (II) | |
| | Duty | 150% | 50% | 20% | 150% | 50% | 20% | 150% | 50% | 20% | 150% | 50% | 20% |
| Test Results | White Concealment | A | — | | A | — | | A | — | | A | — | |
| | Adhesion (W, or Co on W) | A | A | | A | A | | B | A | | A | A | |
| | Drying Properties | | B | | | B | | | B | | | B | |

TABLE 3

| | | Example 8 | | | Example 9 | | | Example 10 | | |
|---|---|---|---|---|---|---|---|---|---|---|
| | | Type of Ink | | | | | | | | |
| | | W ink | Co Ink | Cl Ink | W ink | Co Ink | Cl Ink | W ink | Co Ink | Cl Ink |
| Ink Composition | titanium dioxide pigment | 10% | | | 10% | | | 10% | | |
| | black pigment | | 7% | | | 4% | | | 7% | |
| | styrene acrylic-based resin | 5% | 1% | 6% | 5% | 1% | 6% | 5% | 1% | 6% |
| | polyethylene-based wax | 1% | 1% | 2% | 1% | 1% | 2% | 1% | 1% | 2% |
| | 1,2-hexanediole | 5% | 5% | 5% | 5% | 5% | 5% | 5% | 5% | 5% |
| | 2-pyrrolidone | | | 4% | | 4% | 4% | | 4% | 4% |
| | silicone-based surfactant | 1% | 1% | 1% | 1% | 1% | 1% | 1% | 1% | 1% |
| | acetylene glycol-based surfactant | 0.5% | 0.5% | 0.5% | 0.5% | 0.5% | 0.5% | 0.5% | 0.5% | 0.5% |
| | 1,3-butanediol | 10% | 10% | 14% | 10% | 10% | 14% | 10% | 10% | 14% |
| | ion-exchanged water | residual quantity | residual quantity | residual quantity | residual quantity | residual quantity | residual quantity | residual quantity | residual quantity | residual quantity |
| | Total | 100% | 100% | 100% | 100% | 100% | 100% | 100% | 100% | 100% |
| Recording Conditions | Recording Method | | (II) | | | (II) | | | (III) | |
| | Duty | 150% | 50% | 20% | 150% | 50% | 20% | 150% | 50% | 20% |
| Test Results | White Concealment | A | — | | A | — | | A | — | |
| | Color Development | — | A | — | — | B | — | — | A | — |
| | Adhesion (W, or Co on W) | A | A | | A | A | | A | B | |
| | Drying Properties | | B | | | B | | | B | |

TABLE 3-continued

| | | | Example 11 | | | Example 12 | | |
|---|---|---|---|---|---|---|---|---|
| | | | Type of Ink | | | | | |
| | | | W ink | Co Ink | Cl Ink | W ink | Co Ink | Cl Ink |
| | Ink Composition | titanium dioxide pigment | 10% | | | 10% | | |
| | | black pigment | | 7% | | — | 7% | |
| | | styrene acrylic-based resin | 5% | 1% | 6% | 5% | 1% | 6% |
| | | polyethylene-based wax | 1% | 1% | 2% | 1% | 1% | 2% |
| | | 1,2-hexanediole | 5% | 5% | 5% | 5% | 5% | 5% |
| | | 2-pyrrolidone | | | 4% | | | |
| | | silicone-based surfactant | 1% | 1% | 1% | 1% | 1% | 1% |
| | | acetylene glycol-based surfactant | 0.5% | 0.5% | 0.5% | 0.5% | 0.5% | 0.5% |
| | | 1,3-butanediol | 10% | 10% | 14% | 10% | 10% | 14% |
| | | ion-exchanged water | residual quantity | residual quantity | residual quantity | residual quantity | residual quantity | residual quantity |
| | | Total | 100% | 100% | 100% | 100% | 100% | 100% |
| | Recording Conditions | Recording Method | | (III) | | | (II) | |
| | | Duty | 150% | 50% | 20% | 150% | 50% | 20% |
| | Test Results | White Concealment | A | — | | A | — | |
| | | Color Development | — | A | — | — | A | — |
| | | Adhesion (W, or Co on W) | A | A | | A | A | |
| | | Drying Properties | | A | | | A | |

TABLE 4

| | | Comparative Example 1 | | | Comparative Example 2 | | | Comparative Example 3 | | |
|---|---|---|---|---|---|---|---|---|---|---|
| | | Type of Ink | | | | | | | | |
| | | W ink | Co Ink | Cl Ink | W ink | Co Ink | Cl Ink | W ink | Co Ink | Cl Ink |
| Ink Composition | titanium dioxide pigment | 10% | | | 10% | | | 10% | | |
| | cyan pigment | | 4% | | | 4% | | | 4% | |
| | styrene acrylic-based resin | 5% | 1% | 6% | 5% | 1% | 6% | 5% | 1% | 6% |
| | polyethylene-based wax | 1% | 1% | 2% | 1% | 1% | 2% | 1% | 1% | 2% |
| | 1,2-hexanediole | 5% | 5% | 5% | 5% | 5% | 5% | 5% | 5% | 5% |
| | 2-pyrrolidone | 4% | 4% | 4% | 4% | 4% | 4% | 4% | 4% | 4% |
| | silicone-based surfactant | 1% | 1% | 1% | 1% | 1% | 1% | 1% | 1% | 1% |
| | acetylene glycol-based surfactant | 0.5% | 0.5% | 0.5% | 0.5% | 0.5% | 0.5% | 0.5% | 0.5% | 0.5% |
| | propylene glycol | 10% | 10% | 14% | 10% | 10% | 14% | 10% | 10% | 14% |
| | ion-exchanged water | residual quantity | residual quantity | residual quantity | residual quantity | residual quantity | residual quantity | residual quantity | residual quantity | residual quantity |
| | Total | 100% | 100% | 100% | 100% | 100% | 100% | 100% | 100% | 100% |
| Recording Conditions | Recording Method | | (I) | | | (II) | | | (III) | |
| | Duty | 50% | 100% | 20% | 150% | 50% | 20% | 150% | 50% | 20% |
| Test Results | White Concealment | C | — | | A | — | | A | — | |
| | Adhesion (W, or Co on W) | B | B | | B | B | | B | B | |
| | Drying Properties | | C | | | C | | | C | |

At least one of the background ink and the color ink used in the examples does not substantially contain a pyrrolidone derivative with a standard boiling point of 240° C. or higher. Therefore, it is shown that even when the amount of resin or water on the recording medium increases due to using a resin ink in order to obtain abrasion resistance and adherence, it is possible to record an image which has both excellent drying properties and excellent adherence.

Meanwhile, both the background ink and the color ink used in the comparative examples contain a pyrrolidone derivative with a standard boiling point of 240° C. or higher. Therefore, it is shown that when the amount of resin of water on the recording medium increases due to using the resin ink in order to obtain abrasion resistance and adherence, the drying properties of the image decrease, and the fixing properties of the image also decrease.

Furthermore, the amount of the background color material contained in the image recorded in the first image recording step was calculated by multiplying the actual duty value and the content of the background color material in the background ink with the discharge amount of the ink during a duty of 100% (9.0 mg/inch$^2$). Accordingly, when discharging the background ink at 150%, 100% and 50% duties, the amounts of the background color material contained in the background images were respectively 1.35 mg/inch$^2$, 0.9 mg/inch$^2$ and 0.45 mg/inch$^2$.

The invention is not limited to the embodiments described above, and various modifications thereof are possible. For example, the invention includes configurations which are the substantially the same as the configurations described in the embodiments (for example, configurations having the same function, method and results, or configurations having the same purpose and effect). In addition, the invention includes configurations in which non-essential parts of the configurations described in the embodiments are replaced. In addition, the invention includes configurations exhibiting the same operation and effect as the configurations described in the embodiments or configurations capable of achieving the same purpose. In addition, the invention includes configurations in which known techniques were added to the configurations described in the embodiments.

What is claimed is:

1. An ink jet recording method that discharges ink from a nozzle of an ink jet recording head and records an image to a recording medium, the method comprising:

a first image recording step of recording an image by discharging a background ink containing a background color material such that it adheres to a first region and a second region of the recording medium;

a second image recording step of recording an image by discharging a color ink containing a color material other than the background color material such that it adheres onto the background ink of the first region; and a heating step of heating the recording medium at 35° C. to 100° C., wherein at least one of the following (A) and (B) is satisfied where (A) the second image recording step is a step that records the image by discharging a resin ink, which contains a resin and does not substantially contain the color material, and the color ink at substantially the same time such that they adhere onto the background ink of the first region, and (B) the ink jet recording method further comprises a third image recording step of recording an image by discharging the resin ink such that it adheres onto the color ink of the first region, and wherein at least one of the background ink and the color ink does not substantially contain a pyrrolidone derivative with a standard boiling point of 240° C. or higher.

2. The ink jet recording method according to claim 1, wherein, when (A) is satisfied, the second image recording step includes recording the image by adhering the resin ink onto the background ink of the second region.

3. The ink jet recording method according to claim 1, wherein, when (B) is satisfied, the third image recording step includes recording the image by adhering the resin ink onto the background ink of the second region.

4. The ink jet recording method according to claim 1, wherein both of (A) and (B) are satisfied.

5. The ink jet recording method according to claim 1, wherein neither of the background ink and the color ink substantially contain a pyrrolidone derivative with a standard boiling point of 240° C. or higher.

6. The ink jet recording method according to claim 1, wherein the background ink and the color ink each contain the resin, wherein the total content of the resin and the background color material in the background ink is 9 mass % or more, and wherein the total content of the resin and the color material other than the background color material in the color ink is 9 mass % or more.

7. The ink jet recording method according to claim 1, wherein the amount of the background color material contained in the image recorded in the first image recording step is 0.8 mg/inch$^2$ or more.

8. The ink jet recording method according to claim 1, wherein when (A) is satisfied, the color ink and the resin ink are discharged during the same scan of the ink jet recording head in the second image recording step.

9. An ink jet recording apparatus which uses the ink jet recording method according to claim 1.

10. An ink jet recording apparatus which uses the ink jet recording method according to claim 2.

11. An ink jet recording apparatus which uses the ink jet recording method according to claim 3.

12. An ink jet recording apparatus which uses the ink jet recording method according to claim 4.

13. An ink jet recording apparatus which uses the ink jet recording method according to claim 5.

14. An ink jet recording apparatus which uses the ink jet recording method according to claim 6.

15. An ink jet recording apparatus which uses the ink jet recording method according to claim 7.

16. An ink jet recording apparatus which uses the ink jet recording method according to claim 8.

17. An ink jet recording apparatus, comprising:

an ink jet recording head provided with a nozzle which discharges ink;

a control unit which executes a plurality of modes; and a heating unit, wherein, the plurality of modes include a first mode which records an image by discharging a background ink containing a background color material such that it adheres to a first region and a second region of a recording medium;

a second mode which selects and performs recording an image by discharging a color ink containing a color material other than the background color material such that it adheres onto the background ink of the first region; or recording an image by discharging a resin ink, which contains a resin and does not substantially contain the color material, and the color ink at substantially the same time such that they adhere onto the background ink of the first region; and a heating mode which heats the recording medium at 35° C. to 100° C. using the heating unit, wherein the control unit executes the first mode, the second mode and the heating mode, and wherein at least one of the background ink and the color ink does not substantially contain a pyrrolidone derivative with a standard boiling point of 240° C. or higher.

18. The ink jet recording apparatus according to claim 17, wherein, the plurality of modes further include a third mode which selects and performs recording the image by discharging the resin ink such that it adheres onto the color ink of the first region, or not adhering the resin ink onto the color ink of the first region, and wherein the control unit causes the first mode, the second mode, the third mode and the heating mode to be executed.

* * * * *